US006514152B1

(12) United States Patent
Huang et al.

(10) Patent No.: US 6,514,152 B1
(45) Date of Patent: Feb. 4, 2003

(54) PLATFORM FOR TRAINING GOLF

(76) Inventors: Wen-Liang Huang, 4F, No. 18, Lane 119, Hsingsheng N. Rd., Sec. 2, Taipei (TW); Tzyy-Yuang Shiang, 8F, No. 83, Chengkung Rd., Sec. 2, Yungho City, Taipei Hsein (TW)

( * ) Notice: Subject to any disclaimer, the term of this patent is extended or adjusted under 35 U.S.C. 154(b) by 0 days.

(21) Appl. No.: 10/006,216

(22) Filed: Dec. 10, 2001

(51) Int. Cl.[7] ..... A63B 69/36
(52) U.S. Cl. ..... 473/279; 473/160
(58) Field of Search ..... 473/160, 161, 473/278, 279

(56) References Cited

U.S. PATENT DOCUMENTS 3,633,917 A * 1/1972 Anderson ..... 473/279
3,869,127 A * 3/1975 Kohori ..... 473/279
5,431,406 A * 7/1995 Ishii ..... 248/396
5,470,074 A * 11/1995 Hotchkiss et al. ..... 473/279
5,549,522 A * 8/1996 Chang ..... 473/279
5,820,478 A * 10/1998 Wood et al. ..... 473/279
5,944,615 A * 8/1999 Lee ..... 473/279

* cited by examiner

*Primary Examiner*—Mark S. Graham
(74) *Attorney, Agent, or Firm*—Bacon & Thomas, PLLC

(57) ABSTRACT

The invention relates to a platform device for training golf comprising a base having a hollow half-spherical member on its top surface with a top opening thereon, and an activation mechanism provided within the half-spherical member and having a post extended through the opening to engage with an upper platform so as to enable the user to adjust the platform to one of various oblique angles and orientations about the base for training golf.

9 Claims, 3 Drawing Sheets

PLATFORM FOR TRAINING GOLF

FIELD OF THE INVENTION

The present invention relates to golf training and more particularly to a platform for training golf with improved characteristics.

BACKGROUND OF THE INVENTION

In order to have a healthy body, more and more people throughout the world have engaged in body exercise. As understood that body exercise is good to health both in physical and metal. Hence, body exercise has become a very important part of our life.

It is also understood that basic training is essential for obtaining a good result in exercise or competition. For golf, it remains the same. Thus, swing training is a basic. Many beginners use golf training field as a place to practice swing. However, it is often found that many people perform well in training while showing poorly in a real golf course. If the calmness of a person is assumed to be not a factor in affecting personal performance. After analysis it is found that, for almost all golf training fields, a small piece of artificial turf is provided for people to train golf. Generally, people can only practice swing in a flat ground because the piece of artificial turf is placed on a flat ground too. It is also known that a golf course is not a flat terrain, i.e., there are various slopes. As such, good training does not guarantee a good result.

For solving the above problem, a golf training device having an adjustable platform is developed. The device comprises a platform and a base for supporting the platform. In use, person stands on platform to pivot platform about base by the weight of the person until a desire oblique angle and orientation is obtained. Also, platform comprises a universal joint coupled between platform and base, and a hydraulic mechanism for supporting platform at one of plurality of oblique angles. Hydraulic mechanism comprises a hydraulic cylinder and at least one valve for controlling fluid flow into or out of the hydraulic cylinder. Each hydraulic cylinder comprises at least one fluid reservoir in communication with the hydraulic cylinder through the valve therebetween.

However, such golf training device having an adjustable platform is disadvantageous due to complex structure, excessive components, and high manufacturing cost. All of which inhibit potential buyers. It is also understood that the competition among golf training fields is fierce because the number of golf training fields is large. Hence, procuring such golf training devices is a burden for golf training fields owners. The increased cost may be shared by consumers. As a result, consumers may move to other cheap golf training fields if they feel the charge of one golf training field is not reasonable.

SUMMARY OF THE INVENTION

Thus, it is desirable to provide a platform for training golf in order to overcome the above drawbacks of prior art. For example, a small piece of artificial turf is provided on golf training field for people to train golf. Hence, people can only practice swing in a flat ground because the piece of artificial turf is placed on a flat ground too. Further, it is known that a golf course is not a flat terrain, i.e., there are various slopes. As such, a good training is not possible. Moreover, a commercially available golf training device having an adjustable platform is disadvantageous for high cost.

It is therefore an object of the present invention to provide a platform device for training golf comprising a base including a hollow half-spherical member on a top surface and a top opening on the half-spherical member; an upper platform at an oblique angle about the base and including a concave block conformed to and engaged with a top portion of the half-spherical member and an aperture on a bottom aligned with the opening; and an activation mechanism including a friction member within the half-spherical member, a post extended from the friction member through the opening, the concave block, and the aperture to project above the platform, and a lever pivotably coupled to the post, the lever having an raised section at one end abutted the post and a handle at the other end; wherein when the handle pivots away from the platform, the half-spherical member disengages from the friction member, or when the handle pivots toward the platform, the half-spherical member and the concave block are tightly held by the friction member and the raised section. By utilizing this platform device, user can practice swing on platform at one of various oblique angles and orientations about base for training golf.

The above and other objects, features and advantages of the present invention will become apparent from the following detailed description taken with the accompanying drawings.

DETAILED DESCRIPTION OF THE PREFERRED EMBODIMENTS

Figure 1:
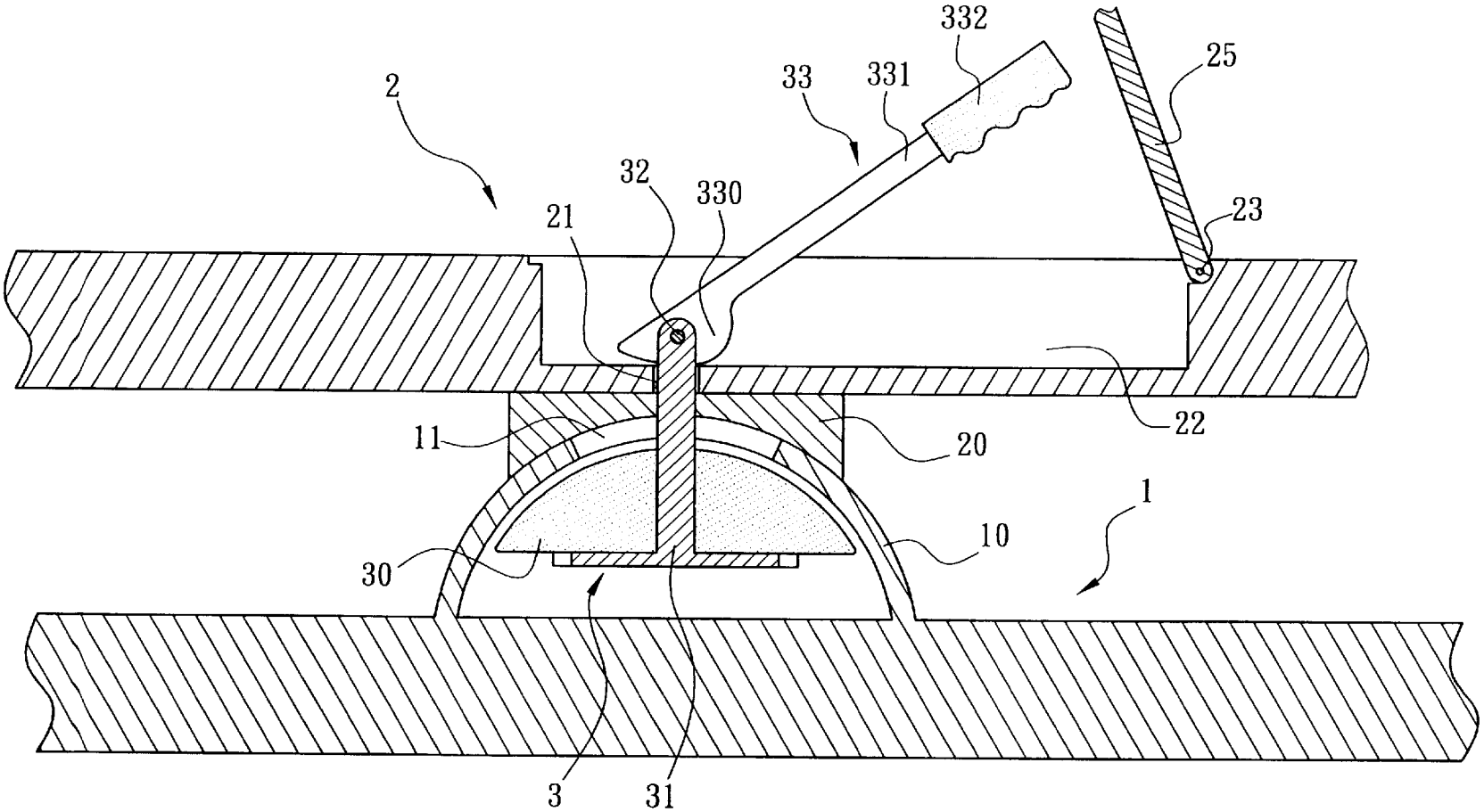
FIG. 1 is a cross-sectional view showing a mechanism for adjusting an angle of platform with respect to base according to a platform device for training golf of the invention.

Referring to FIG. 1, there is shown a platform device for training golf constructed in accordance with the invention comprising a base 1 including a hollow half-spherical member 10 on top surface and a top opening 11 on half-spherical member 10; an upper platform 2 at an oblique angle about base 1 and including a concave block 20 conformed to and engaged with top portion of half-spherical member 10 and an aperture 21 on bottom aligned with opening 11; and an activation mechanism 3 including a friction member 30 within half-spherical member 10, friction member 30 having a top surface conformed to inner wall of half-spherical member 10, a post 31 extended from bottom of friction member 30 through opening 11, concave block 20, and aperture 21 to project above platform 2, a pivot 32 on top of post 31, and a lever 33 coupled to post 31 at pivot 32, lever 33 having an raised section 330 at one end abutted the pivot 32 and a handle 331 at the other end.

Figure 2:
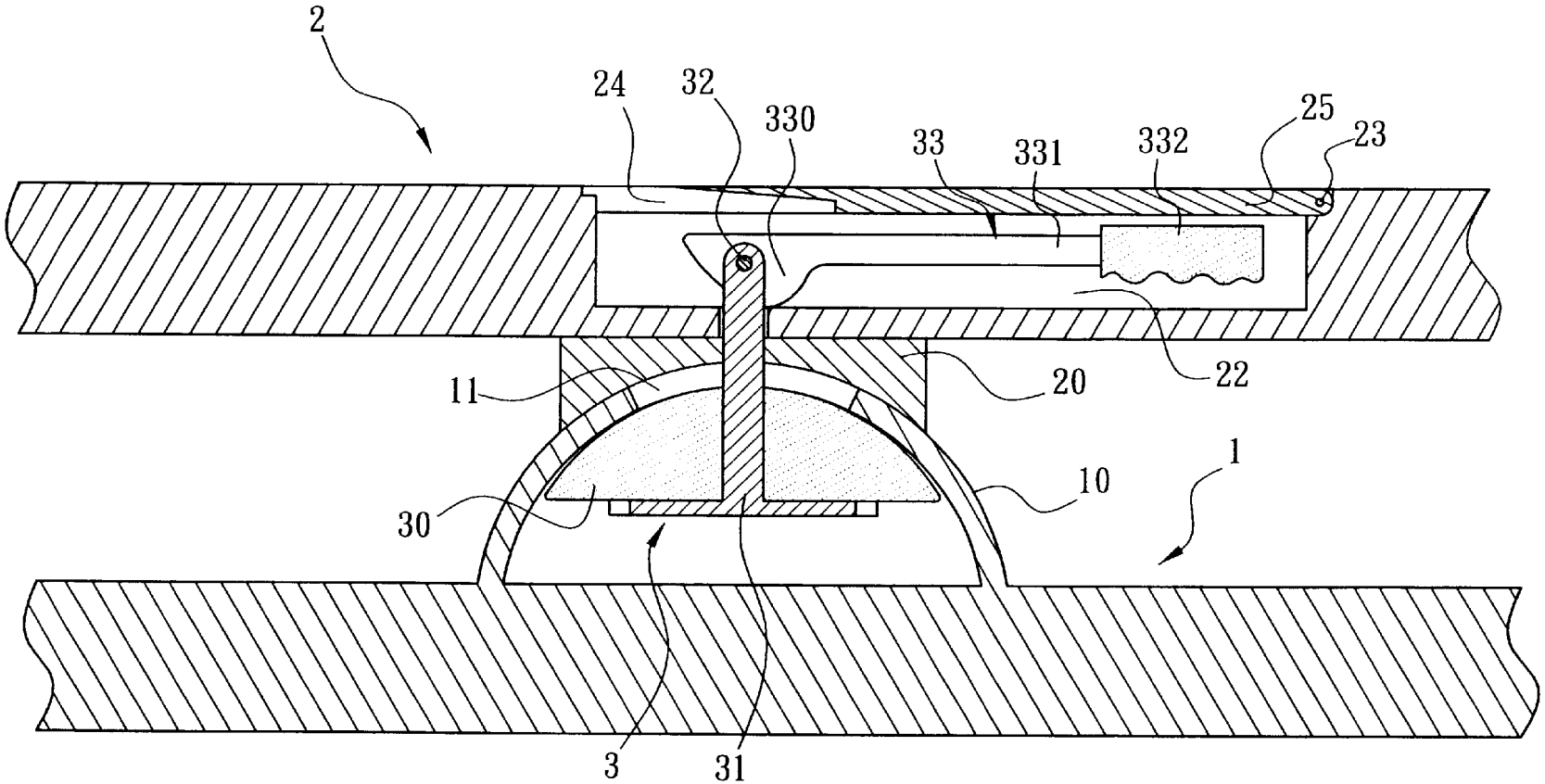
FIG. 2 is another cross-sectional view of FIG. 1.
Figure 3:
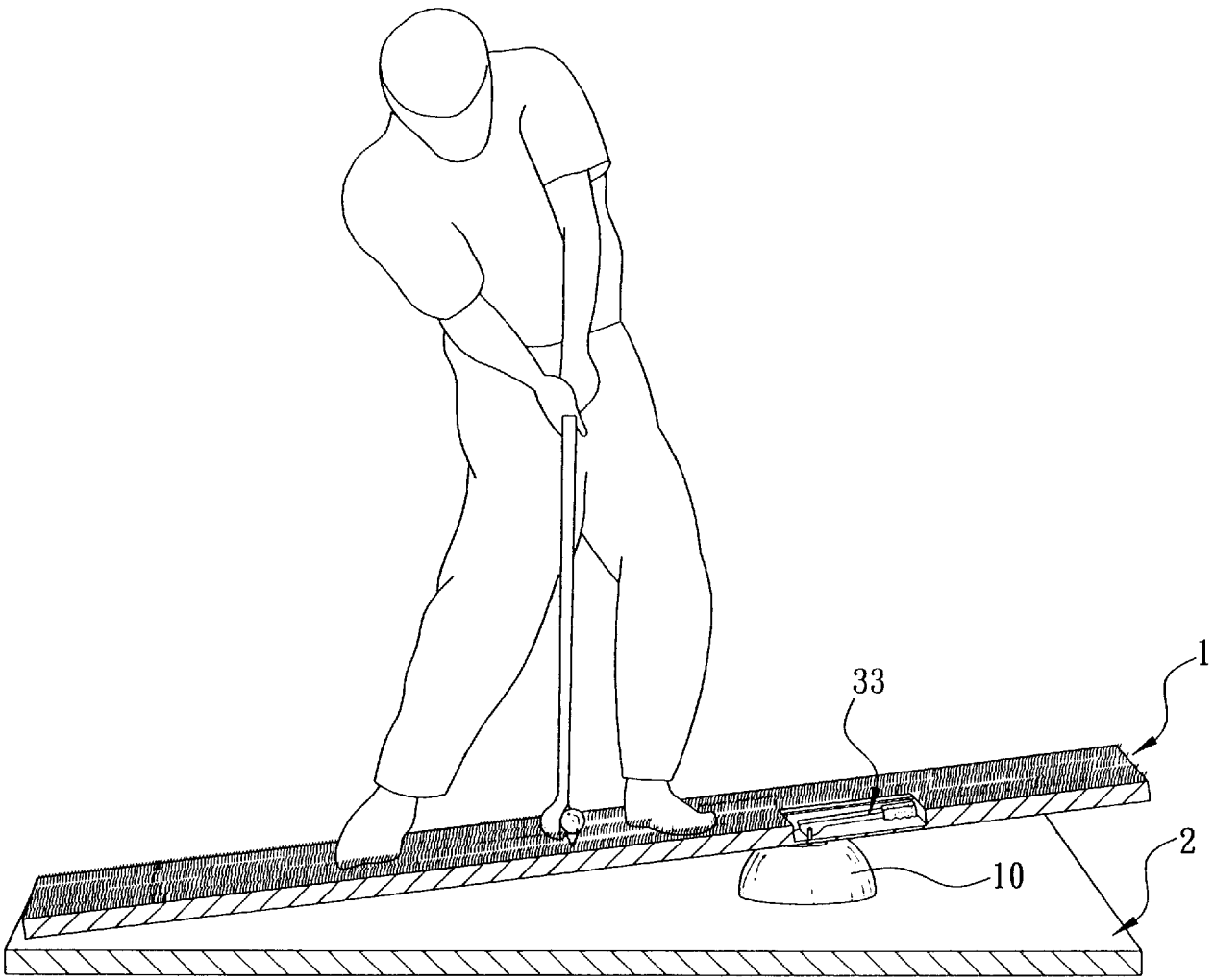
FIG. 3 is an environmental view showing a person practicing swing on the FIG. 1 platform device.

As handle 331 pivots away from platform 2, large portion of raised section 330 is engaged with platform 2. Hence, post 31 is moved downwardly further into half-spherical member 10. As a result, half-spherical member 10 disengages from friction member 30. During the disengagement process, a desired oblique angle of platform 2 with respect to base 1 can be obtained. To the contrary, as referring to FIG. 2, as handle 331 pivots toward platform 2, only small portion of raised section 330 is engaged with platform 2. Hence, post 31 is moved upwardly to pull friction member 30 up. Hence, half-spherical member 10 and concave block 20 are tightly held by friction member 30 and raised section 330. As a result, platform 2 is fixed at a desired oblique angle of platform 2 with respect to base 1. With this configuration, as referring to FIG. 3, people can swing golf at one of various oblique angles and/or orientations of platform 2 with respect to base 1 for training.

Referring to FIG. 2 again, a cavity 22 is formed on top surface of platform 2 for receiving lever 33. At this position (i.e., lever 33 is not projected on platform 2), lever 33 does not hinder the swing of person. Further, platform 2 will not loosen after a desired oblique angle of platform 2 with respect to base 1 has been adjusted.

Referring to FIG. 2 again, a cover 25 is provided on cavity 22. One side of cover 25 is pivotably coupled to that of cavity 22 by a fast butt hinge 23. The other side of cover 25 is formed as a finger indent 24 for allowing user to position his or her finger in the indent 24 to lift cover 25.

Referring to FIG. 2 again, a first pad is formed on a contact surface of half-spherical member 10 and friction member 30 for increasing a friction with concave block 20.

Referring to FIG. 2 again, a second pad is formed on a contact surface of friction member 30 and half-spherical member 10 for increasing a friction with concave block 20.

Referring to FIG. 2 again, a plastic handle grip 332 is formed over the free end of handle 331 to provide user with a degree of comfort while holding the handle 331.

Referring to FIG. 3 again, a piece of artificial turf is formed on top surface of platform 2 for simulating the ground of real golf course.

While the invention has been described by means of specific embodiments, numerous modifications and variations could be made thereto by those skilled in the art without departing from the scope and spirit of the invention set forth in the claims.

What is claimed is:

1. A platform device for golf training comprising:

a base including a hollow half-spherical member on a top surface and a top opening on the half-spherical member;

an upper platform at an oblique angle about the base and including a concave block conformed to and engaged with a top portion of the half-spherical member and an aperture on a bottom aligned with the opening; and an activation mechanism including a friction member within the half-spherical member, a post extended from the friction member through the opening, the concave block, and the aperture to project above the platform, and a lever pivotably coupled to the post, the lever having a raised section at one end abutting the post and a handle at the other end;

wherein when the handle pivots away from the platform, the half-spherical member disengages from the friction member, or when the handle pivots toward the platform, the half-spherical member and the concave block are tightly held by the friction member and the raised section.

2. The platform device of claim 1, further comprising a cavity formed on a top surface of the platform for receiving the lever so that at this position the lever does not hinder a swing of user and the platform does not loosen after a desired oblique angle of the platform with respect to the base has been adjusted.

3. The platform device of claim 2, further comprising a cover formed on the cavity.

4. The platform device of claim 3, further comprising a fast butt hinge on one side of the cover for pivotably coupling to a side of the cavity.

5. The platform device of claim 3, further comprising a finger indent formed on the other side of the cover for facilitating opening the cover.

6. The platform device of claim 1, further comprising a first pad formed on a contact surface of the half-spherical member and the friction member for increasing a first friction with the concave block.

7. The platform device of claim 1, further comprising a second pad formed on a contact surface of the friction member and the half-spherical member for increasing a second friction with the concave block.

8. The platform device of claim 1, further comprising a plastic handle grip formed over the other end of the handle.

9. The platform device of claim 1, further comprising a piece of artificial turf formed on the top surface of the platform.

* * * * *